US008107873B2

(12) United States Patent
Nakazawa et al.

(10) Patent No.: US 8,107,873 B2
(45) Date of Patent: Jan. 31, 2012

(54) IMAGE FORMING APPARATUS CONVEYING SHEETS BASED ON PREVIOUSLY CONVEYED SHEETS

(75) Inventors: Shinji Nakazawa, Kyoto (JP); Yoshiharu Yoneda, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 749 days.

(21) Appl. No.: 11/806,508

(22) Filed: May 31, 2007

(65) Prior Publication Data

US 2007/0280764 A1 Dec. 6, 2007

(30) Foreign Application Priority Data

Jun. 2, 2006 (JP) ..... 2006-155157

(51) Int. Cl.
*G03G 15/00* (2006.01)

(52) U.S. Cl. ..... 399/394; 399/395; 399/396

(58) Field of Classification Search ..... 399/394, 399/395, 396
See application file for complete search history.

(56) References Cited

U.S. PATENT DOCUMENTS

| | | | | |
|---|---|---|---|---|
| 5,112,038 | A * | 5/1992 | Dunaway | 271/10.03 |
| 6,148,172 | A * | 11/2000 | Kanda et al. | 399/391 |
| 6,345,170 | B1 * | 2/2002 | Nakazato et al. | 399/388 |
| 6,397,035 | B2 * | 5/2002 | Kataoka et al. | 399/388 |
| 7,408,568 | B2 * | 8/2008 | Kobayashi | 347/262 |
| 2004/0062582 | A1 * | 4/2004 | Dobbertin et al. | 399/394 |

FOREIGN PATENT DOCUMENTS

| | | | |
|---|---|---|---|
| JP | 1-108562 | A | 4/1989 |
| JP | 05-193790 | A | 8/1993 |
| JP | 9-156802 | A | 6/1997 |
| JP | 2002-99192 | A | 4/2002 |
| JP | 2005-62745 | A | 3/2005 |

* cited by examiner

*Primary Examiner* — Matthew G Marini

(74) *Attorney, Agent, or Firm* — Birch, Stewart, Kolasch & Birch, LLP

(57) ABSTRACT

One embodiment of an image forming apparatus according to the present invention is an image forming apparatus in which registration rollers are arranged immediately before an electrostatic latent bearing member and, after a carried paper is caused to temporarily stop by the registration rollers, carrying of the paper recommences with a timing enabling a leading edge of image information visualized on the electrostatic latent bearing member and a leading edge of the paper that has been stopped by the registration rollers to correspond, wherein, at a time of successive printing of multiple sheets, a carrying recommencement timing of an immediately subsequent paper is determined using information of a carrying recommencement timing of an immediately preceding carried paper.

10 Claims, 9 Drawing Sheets

IMAGE FORMING APPARATUS CONVEYING SHEETS BASED ON PREVIOUSLY CONVEYED SHEETS

BACKGROUND OF THE INVENTION

This application claims priority under 35 U.S.C. §119(a) on Patent Application No. 2006-155157 filed in Japan on Jun. 2, 2006, the entire contents of which are hereby incorporated by reference.

FIELD OF THE INVENTION

The present invention relates to image forming apparatuses in which, after a carried paper is temporarily stopped by registration rollers, carrying of the paper recommences with a timing by which a leading edge of image information visualized on an electrostatic latent bearing member and a leading edge of the paper stopped by the registration rollers are made to correspond, and more specifically relates to image forming apparatuses that support high speed machines capable of carrying more than 100 sheets per minute to a transfer portion.

BACKGROUND ART

For reasons related to installation space, mainstream image forming apparatuses of recent years have been of a space-saving vertical carrying type. That is, these are constructed such that a plurality of paper supply cassettes are arranged stacked in a lower portion of the apparatus main unit and a transfer portion and a fixing portion are arranged in an upper portion thereof. In these structures, a carried paper that has been supplied from the paper supply cassette is initially carried upward then carried toward the transfer portion after being changed to horizontal direction carrying by being bent substantially 90 degrees in front of the transfer portion.

FIG. 10A shows a configuration of the sheet carry path on a front side of the transfer portion.

Pairs of carry rollers R31 and R32, pre-registration rollers R41 and R42, and registration rollers R51 and R52 are arranged in order along a paper carry direction S of a sheet carry path 28, which is arranged in a bent shape as mentioned above, and the registration rollers R51 and R52 are provided facing a nip portion N1 with a distance of approximately 50 mm, the nip portion N1 being a contact portion between an electrostatic latent bearing member (photosensitive drum) 14 and a transfer roller 17*a*.

FIG. 11 is a chart showing an operation timing of the registration rollers R51 and R52 and the pre-registration rollers R41 and R42.

That is, when paper P is carried on the sheet carry path 28 until the registration rollers R51 and R52 and the paper leading edge contacts a nip portion N5 of the registration rollers R51 and R52, the registration rollers R51 and R52 first stop at a time t1 then at a slightly subsequent time t2, the pre-registration rollers R41 and R42 stop. Due to stopping with this time gap, the paper P that is sandwiched by the registration rollers R51 and R52 and the pre-registration rollers R41 and R42 is held in a flexed state in a slightly bent form as shown in FIG. 10A. At this time, as shown in FIG. 10B, variation in a run-out amount L1 of the paper P from the nip portion N5 of the registration rollers R51 and R52 occurs due to such factors as the paper size, thickness, paper strength, and the balance of pressing force between the registration rollers R51 and R52.

After this, the registration rollers R51 and R52 and the pre-registration rollers R41 and R42 again commence carrying of the paper P at a time t3, which is a timing that enables the leading edge of the paper P, in which unevenness of the run-out amount L1 occurs, and the leading edge of image information that is visualized on the electrostatic latent bearing member (photosensitive drum) 14 to correspond. By causing the paper P to be flexed slightly at this time, the feed timing for the leading edge of the paper P from the registration rollers R51 and R52 can be made consistent along the width direction of the paper, thereby preventing slanted carrying of the paper P and eliminating width direction deformation of the image to be formed on the paper P. That is, the paper P that is temporarily stopped by the registration rollers R51 and R52 undergoes during the stoppage fine adjustments of leading edge positions in a direction parallel to the paper carrying direction S, center alignment of the carried paper, and correction of slanted carrying at the time of carrying, by the registration rollers R51 and R52.

In this regard, there is a demand for image forming apparatuses of recent years to achieve greater speeds in print processing compared to conventional image forming apparatuses. For example, conventionally machines that achieve 60 sheets/min or more (for A4 sideways carrying) were considered a high speed machine, but in recent years machines that achieve 80 sheets/min or more are called high speed machines and moreover development is advancing on image forming apparatuses capable of 100 to 120 sheets/min or more.

With this image forming apparatuses, it is necessary to aim for improvements in print quality when the toner image on the electrostatic latent bearing member (photosensitive drum) is transferred onto paper, and increasing the accuracy of positional alignment between the leading edge of image information that has been visualized on the above-mentioned electrostatic latent bearing member (photosensitive drum) and the leading edge of the paper P being stopped by the registration rollers R51 and R52 is an important factor in maintaining this print quality.

JP H09-156802A proposes a paper transport system as a technique for improving this positional alignment.

This paper transport system is configured such that a time from when a timing roller commences rotation to when a sensor detects the leading edge of the paper is compared with a standard time that is set in advance, the leading edge of the paper and the leading edge of the image formation region on the photosensitive drum are made to correspond by having a timing roller move upstream or downstream in the paper carrying direction based on the difference between these.

However, due to the increased paper carrying speeds in high speed machines of recent years, there is greater unevenness in the stopping positions of the paper leading edge at the registration rollers and when performing successive printing of multiple sheets, it has become difficult time-wise to perform timing adjustments on the carried papers that are subsequent to the first sheet. That is, since there is time available during device initialization or the like, the time available for adjustment at the registration roller area can be maintained for the printing of the first sheet by quickening the timing of supply from the paper supply portion. However, the paper carrying timing for the second sheet and onward is dependent on the print processing speed, that is, the carrying speed, and since the writing of image information onto the electrostatic latent bearing member (photosensitive drum) commences before the paper leading edge contacts the nip portion of the registration rollers, there is no time available at all for performing positional adjustments of the paper leading edge at the registration roller area for the second sheet and onward.

SUMMARY OF THE INVENTION

The present invention has been devised in light of these circumstances and it is an object thereof to provide an image forming apparatus capable of performing highly accurate positional alignment of the paper leading edge and the image information leading edge in high speed machines by using information of the carrying recommencement timing of the immediately preceding carried paper to determine the carrying recommencement timing of the paper by the registration rollers for making the paper leading edge and the leading edge of the image information correspond during print processing of multiple sheets.

In order to address these issues, an image forming apparatus according to the present invention includes an image forming apparatus in which registration rollers are arranged immediately before an electrostatic latent bearing member and, after a carried paper is caused to temporarily stop by the registration rollers, carrying of the paper recommences with a timing enabling a leading edge of image information visualized on the electrostatic latent bearing member and a leading edge of the paper that has been stopped by the registration rollers to correspond, wherein, at a time of successive printing of multiple sheets, a carrying recommencement timing of an immediately subsequent paper is determined using information of a carrying recommencement timing of an immediately preceding carried paper. With this configuration, positional alignment of the paper leading edge and the image information leading edge can be carried out with excellent accuracy even for high speed machines.

Specifically, a detection means for detecting a leading edge stopping position of the carried paper that has been temporarily stopped by the registration rollers is provided, wherein the carrying recommencement timing of the immediately subsequent paper is determined based on a detection value of the detection means of the immediately preceding carried paper. Furthermore, the carrying recommencement timing of the immediately subsequent paper is determined based on an average value of all detection values of all preceding papers. That is, the carrying recommencement timing for the next sheet is always determined using the detection value of the one preceding sheet. Positional displacement of the paper leading edge often occurs gradually over time and there is no extreme variation between a preceding sheet and a subsequent sheet. The present invention gives attention to this point.

However, in successive printing of multiple sheets (for example, large volume printing of around 500 sheets), it is conceivable that thermal expansion will occur due to the heat produced by rubbing between the registration rollers and the paper, and since the paper leading edge stopping positions may gradually change due to this thermal expansion or the like, the accuracy will be worsened when using the earlier values in the average value calculations indefinitely.

Accordingly, the present invention is configured such that a number of sheets for successive printing for which there is a print request is divided into a preset multiple number of sheets, and is a calculation process of the average value is executed by performing initialization for each division. Here, the number of sheets for dividing may be set as desired, but for example if 150 sheets are to undergo successive printing, it is conceivable division is carried out for every 30 sheets. In this case, the carrying recommencement timing for an initial first sheet of paper in each division may be determined based on a detection value of a final sheet of an immediately preceding division.

It should be noted that there is no limitation to the above-mentioned divisions when initializing the calculation processing of the average value. For example, a plurality of paper storage portions may be provided and the calculation process of the average value may be initialized when the paper storage portion, which is to supply paper during successive printing processing of a single print request, has been switched. Since there are cases where the paper type may change and cases where the paper size may change due to switching of the paper storage portion, continuing to use the pre-change data as it is may not be desirable in terms of detection accuracy. Consequently, when the paper storage portion has been switched, the calculation processing of the average value is first initialized and calculation is set to commence from the beginning.

Furthermore, a calculation process of the average value may be initialized when a print processing operation is interrupted during successive printing processing of a single print request process. Conceivable cases where print processing operations are interrupted include for example when toner replenishment to the developing device cannot keep up due to high speed printing and the process is interrupted until sufficient toner can be replenished, and when the fixing temperature has dropped excessively and the process is interrupted until the fixing device has risen to a temperature capable of fixing.

Furthermore, when successive printing is being carried out at high speed, it is possible that the registration rollers will expand due to the heat produced by abrasion between the nip portion of the registration rollers and the sheets that pass therebetween. And due to the registration rollers being subjected to expansion or the like, it is probable that the leading edge stopping positions of the sheets sandwiched there will vary greatly from a certain point in time. Accordingly, the present invention gives consideration to this point and may be configured such that a difference value between detection values of leading edge stopping positions of every two sheets that are carried successively is obtained and a calculation process of the average value is initialized when the difference value has exceeded a preset allowable value. Thus, even if the paper leading edge stopping position suddenly varies greatly due to a cause such as the heat produced in the registration rollers, it becomes possible to handle this immediately and to determine the carrying recommencement timings with excellent accuracy.

On the other hand, this may also be configured such that in a case where a next print request is to be executed following completion of a single print request, a calculation process of the average value is not initialized and continues as is when there is a same paper storage portion to supply paper. That is, the paper to be supplied will be the same if it is from the same paper storage portion, and it is highly probable that the leading edge stopping position of the paper to be sandwiched by the registration rollers will be substantially the same as up until that point. Thus, in such cases, even when the print job is different, the calculation processing for the average value continues as it is when printing is to be carried out successively.

Furthermore, the present invention may be configured such that the carrying recommencement timing is determined for each printing surface of the paper when a printing mode is double sided printing. Even for the same paper, the contact condition may vary when sandwiched by the registration rollers in regard to paper printed on one side and paper that is not printed on either side, and therefore it is highly probable that the paper leading edge stopping positions will vary when the papers contact and are stopped by the registration rollers. Thus the present invention gives consideration to this point and executes calculation processing of the average values by respectively separating the case of paper printed on one side and the case of paper printed on neither side when carrying out double sided printing. Thus, even for double sided printing, it becomes possible to determine the carrying recommencement timings with excellent accuracy depending on the condition for printing to the paper (an unprinted state and a state of being printed on one side).

It should be noted that the present invention may also be configured such that a carrying recommencement timing is determined for a first sheet at commencement of successive printing of multiple sheets based on a detection value of that sheet. For the first sheet at commencement, the apparatus itself is undergoing initialization processing and there is time until the first sheet is to actually undergo print processing. Consequently, that time is used to carry the first sheet of paper to the registration rollers in advance, then the leading edge stop position of that sheet is detected and the carrying recommencement timing may be determined based on that detection value.

DESCRIPTION OF THE PREFERRED EMBODIMENTS

Hereinafter, an image forming apparatus according to embodiments of the present invention is described with reference to the accompanying drawings.

Figure 1:
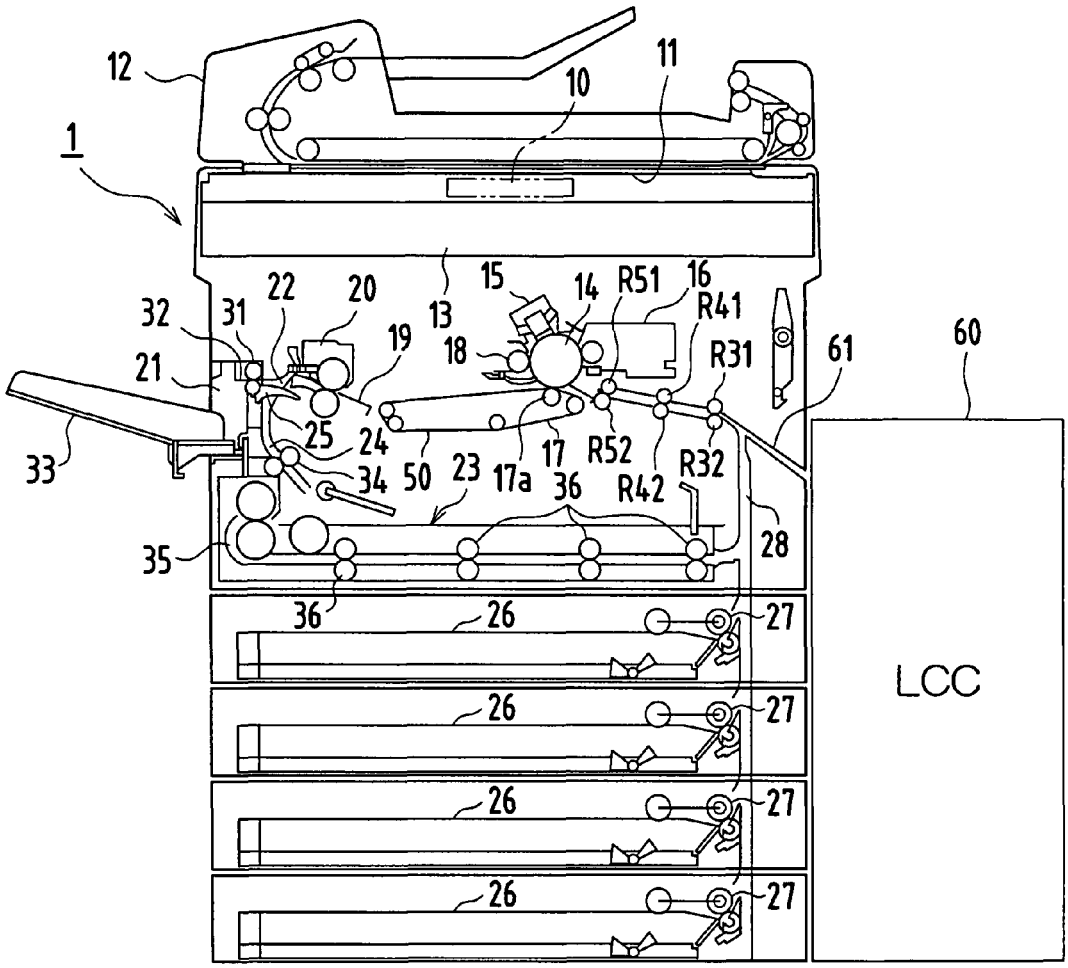
FIG. 1 is a side view showing an entire configuration of an image forming apparatus according to the present invention.

FIG. 1 is a side view showing an entire configuration of an image forming apparatus according to the present embodiment.

An image forming apparatus 1 according to the present embodiment is a digital image forming apparatus for example having various modes such as copying, printing, scanning, and faxing, and is provided with an operation panel 10 on a front surface side.

A hard, transparent glass material platen 11 is arranged on an upper surface of the image forming apparatus 1 and an automatic document feeding device 12 is arranged above the platen 11 while an optical unit 13 is arranged below the platen 11.

A photosensitive drum 14 whose surface is constituted by a photoconductive material is rotatably supported below the optical unit 13. Provided around the photosensitive drum 14 are a charging device 15, a developing device 16, a transfer unit 17, and a cleaner 18, and these are arranged in a state facing a circumferential surface of the photosensitive drum 14.

When instruction is given for commencement of an image formation process by operation of the operation panel 10 in the above-structured image forming apparatus 1, the optical unit 13 scans an image surface of the document placed on the platen 11 and reflected light from the document image surface of light from a copy lamp in the optical unit 13 is irradiated onto a surface of the photosensitive drum 14.

Prior to being irradiated by reflected light from the document, the surface of the photosensitive drum 14 is charged by the charging device 15 so as to have a uniform electric charge of a single polarity, and due to a photoconductive effect of the irradiation of reflected light from the document, an electrostatic latent image is formed on the surface of the photosensitive drum 14. Toner is supplied from the developing device 16 to the surface of the photosensitive drum 14 on which an electrostatic latent image is formed, and the electrostatic latent image is visualized into a developer image.

On the downstream side of the photosensitive drum 14 is arranged a fixing unit 20 constituted by a heating roller and a pressure roller. A transfer belt 50 of the transfer unit 17 and a paper guide 19 are arranged between the fixing unit 20 and the photosensitive drum 14, and a sheet carry path is formed from the photosensitive drum 14 to the fixing unit 20 by the transfer belt 50 and the paper guide 19.

A discharge tray 33 is provided on a lateral surface of the image forming apparatus 1 and a discharge carry path 22 is formed between the fixing unit 20 and the discharge tray 33. A portion of the discharge carry path 22 is diverted via a diverting gate 25 to a re-carry path 24 that is linked to an automatic double-side paper supply device 23 arranged below the photosensitive drum 14.

Figure 10A:
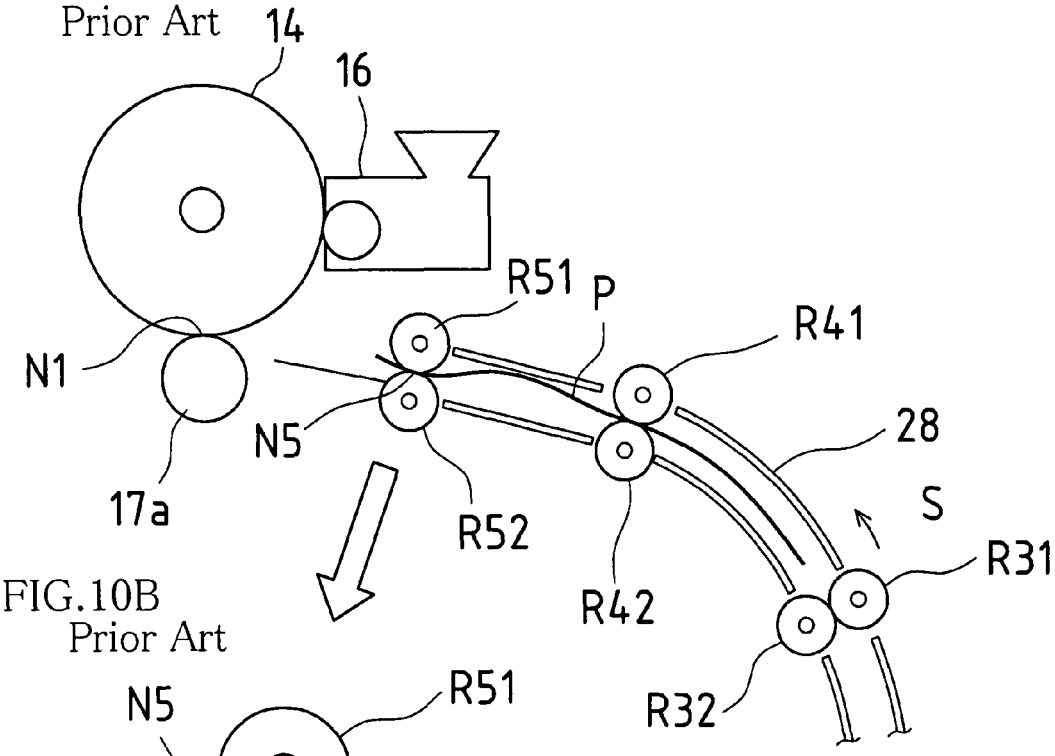
FIG.10A Prior Art
FIG. 10A is an explanatory diagram showing a configuration of the sheet carry path on a front side of the transfer portion.
Figure 10B:
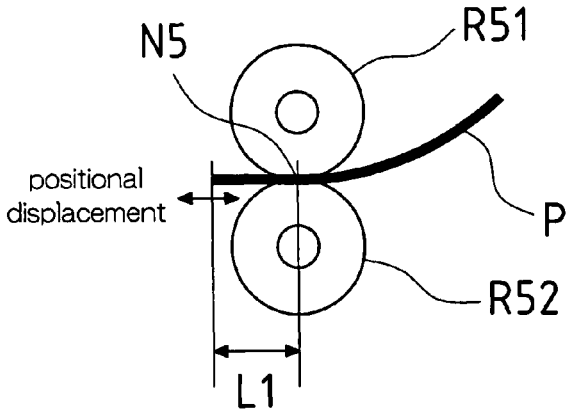
FIG.10B Prior Art
FIG. 10B is an explanatory diagram showing an enlargement of a registration roller area.
Figure 11:
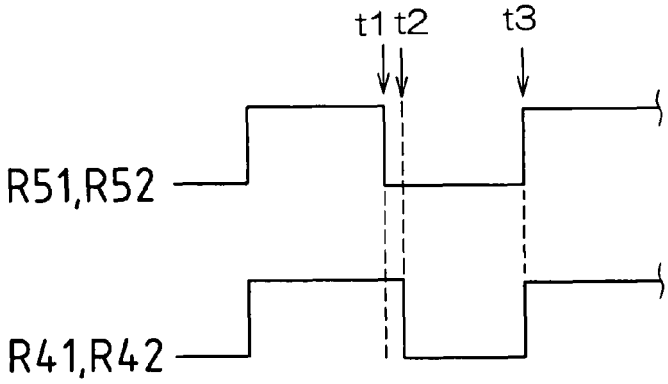
FIG.11 Prior Art
FIG. 11 is a chart showing an operation timing of registration rollers and pre-registration rollers.

Four paper supply cassettes 26 that are detachably loaded from the front surface side of the image forming apparatus 1 are provided in a lower portion of the image forming apparatus 1. Each of the paper supply cassettes 26 contains paper of a different size and prior to rotation of the photosensitive drum 14, paper from one paper supply cassette 26 of the four paper supply cassettes 26 is supplied via a paper supply roller 27. Paper that has been supplied is carried toward the photosensitive drum 14 by the carry rollers R31 and R32 via a shared carry path 28, then its trailing edge is sandwiched by the pre-registration rollers R41 and R42 and its front edge makes contacts and stops at the registration rollers R51 and R52. The configuration of this portion is the same as the configuration shown in FIG. 10. Furthermore, the operation timing of the registration rollers R51 and R52 and the pre-registration rollers R41 and R42 is also the same operation timing as shown in FIG. 11.

Furthermore, the image forming apparatus 1 of the present embodiment is provided with a large capacity paper supply unit (LCC) 60. Details of the structure of the large capacity paper supply unit 60 are omitted here, but paper supplied from the large capacity paper supply unit 60 is carried toward the photosensitive drum 14 by the carry rollers R31 and R32 via a unit-side carry path 61 that merges with the shared carry path 28 before the carry rollers R31 and R32, then its trailing edge is sandwiched by the pre-registration rollers R41 and R42 and its front edge makes contacts and stops at the registration rollers R51 and R52.

The registration rollers R51 and R52 rotate in synchronization with the rotation of the photosensitive drum 14 and introduce the paper to a nip portion (image formation region) N1 between the photosensitive drum 14 and the transfer unit 17. The paper that has been introduced to the image formation region receives a corona discharge of the transfer unit 17 and the developer image held on the surface of the photosensitive drum 14 is transferred to a surface of the paper.

The paper onto which the developer image has been transferred is carried to the fixing unit 20 along the transfer belt 50 and the paper guide 19 and subjected to heat and pressure by the fixing unit 20 such that the developer image is fused and fixed onto the surface of the paper.

In single sided printing mode in which an image is printed on a single side of the paper, the paper that has passed through the fixing unit 20 is discharged from a discharge outlet 32 by a discharge roller 31 via the discharge carry path 22 onto the discharge tray 33. At this time, the discharge roller 31 is driven backward and forward along the paper carrying direction by a discharge roller drive portion 21, which is a characteristic of the present invention.

In double sided printing mode in which images are printed on both sides of the paper, the diverting gate 25 becomes exposed to a portion of the discharge carry path 22 and the paper that has passed through the fixing unit 20 is carried to the automatic double-side paper supply device 23 via the re-carry path 24, which is provided with a carry roller 34. The paper that has been carried to the automatic double-side paper supply device 23 is supplied in a state in which it has been inverted back to front by a re-supplying roller 35, and is again carried via the shared carry path 28 by a re-carrying roller 36 toward the photosensitive drum 14 in a state in which its front and reverse surfaces are inverted, then its trailing edge is sandwiched by the pre-registration rollers R41 and R42 and its front edge makes contacts and stops at the registration rollers R51 and R52.

Figure 2A:
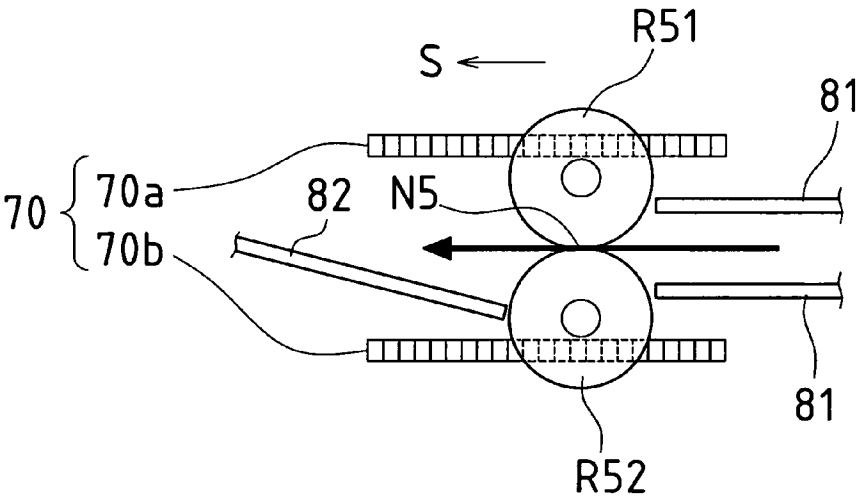
FIG. 2A is a side view of a paper leading edge detection means and FIG. 2B is a plan view of the same.
Figure 2B:
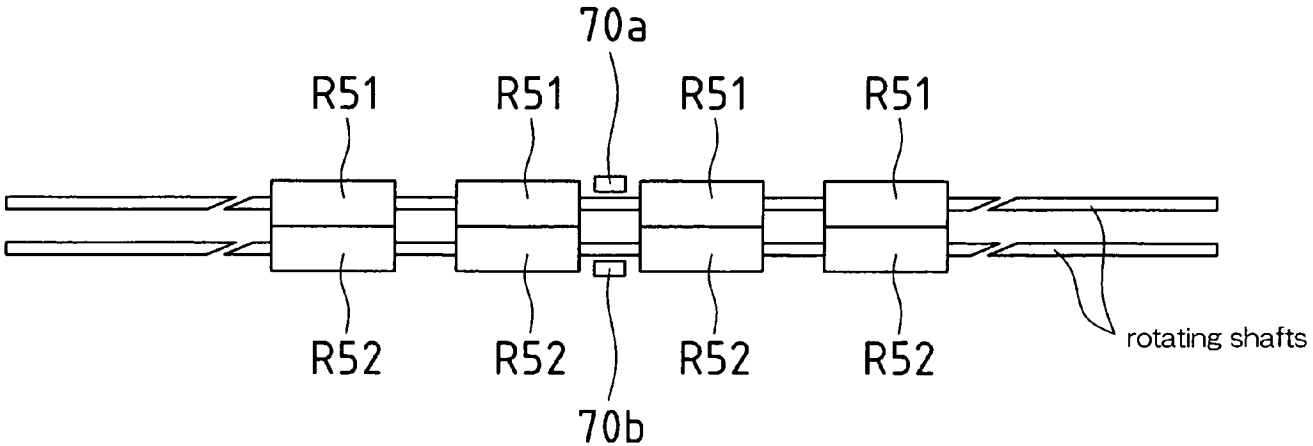

FIG. 2A and FIG. 2B show a structural example of a paper leading edge detection means 70 that detects a leading edge stopping position of paper that has made contact and stopped at the registration rollers R51 and R52. As shown in FIG. 2B, the registration rollers R51 and R52 involve four pairs of registration rollers R51 and R52 arranged widthwise with predetermined spacings, and a light emitting-side line sensor 70*a* and a light receiving-side line sensor 70*b* face each other above and below the sheet carry path in a substantially central area widthwise thereof, and are arranged along the paper carrying direction S that is orthogonal to the registration rollers R51 and R52. As shown in FIG. 2A, the line sensors 70*a* and 70*b* are arranged so as to be provided extending before and after (in the paper carrying direction S) a nip portion N5 of the registration rollers R51 and R52, and in particular are arranged slightly longer on the photosensitive drum 14 side from the nip portion N5. It should be noted that the paper is being guided on the paper carry route by pre-registration paper guides 81 and a post-registration paper guide 82.

Figure 3:
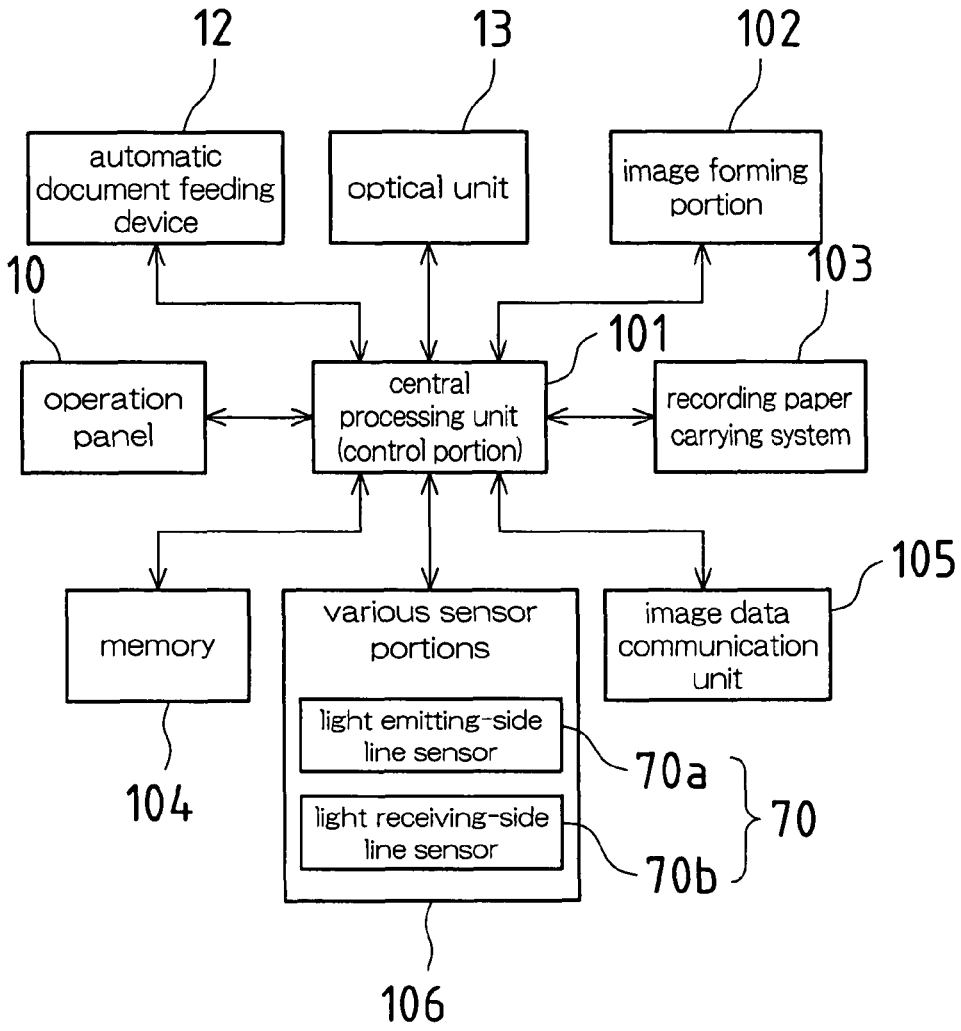
FIG. 3 is a block diagram showing a configuration of a control system of an image forming apparatus according to the present invention.

Next, a configuration of a control system in the image forming apparatus 1 of the above-described structure is described with reference to the block diagram shown in FIG. 3.

A central processing unit (control portion) 101 performs sequence control-based management of the various drive mechanism portions that constitute the image forming apparatus 1 such as the automatic document feeding device 12, the optical unit 13, an image forming portion 102, and a paper carrying system 103, and outputs control signals to the various portions based on detection values of various sensor portions 106 including the above-mentioned paper leading edge detection means 70 (the light emitting-side line sensor 70*a* and the light receiving-side line sensor 70*b*).

The operation panel 10 is connected to the control portion 101 in a mutually communicable state, and the image forming apparatus 1 is able to be caused to function in accordance with print processing conditions involving input of settings by the user based on operation of the operation panel 10.

Furthermore, a memory 104 and an image data communication unit 105 are connected to the control portion 101. The memory 104 stores various control information necessary in controlling the various drive mechanism portions that constitute the image forming apparatus 1. Furthermore, detection values of paper leading edge stopping positions detected by the paper leading edge detection means 70 are successively stored as a history in the memory 104. The image data communication unit 105 is a communication unit provided for enabling information communication of image information and image control signals and the like with other digital image devices.

The control portion 101 carries out print processing control according to print processing conditions that have been inputted and set by the user via operation of the operation panel 10, but when there is successive print processing of multiple sheets at this time, processing is executed by controlling the paper carrying system 103 based on detection values of the paper leading edge detection means 70, wherein the carrying recommencement timing of the paper being temporarily stopped by the registration rollers R51 and R52 is determined using information of the carrying recommencement timing of the immediately preceding carried paper.

Next, specific working examples are given to facilitate description of the processing by which the carrying recommencement timing of the paper being temporarily stopped by the registration rollers R51 and R52 is determined using information of the carrying recommencement timing of the immediately preceding carried paper.

WORKING EXAMPLE 1

Figure 4:
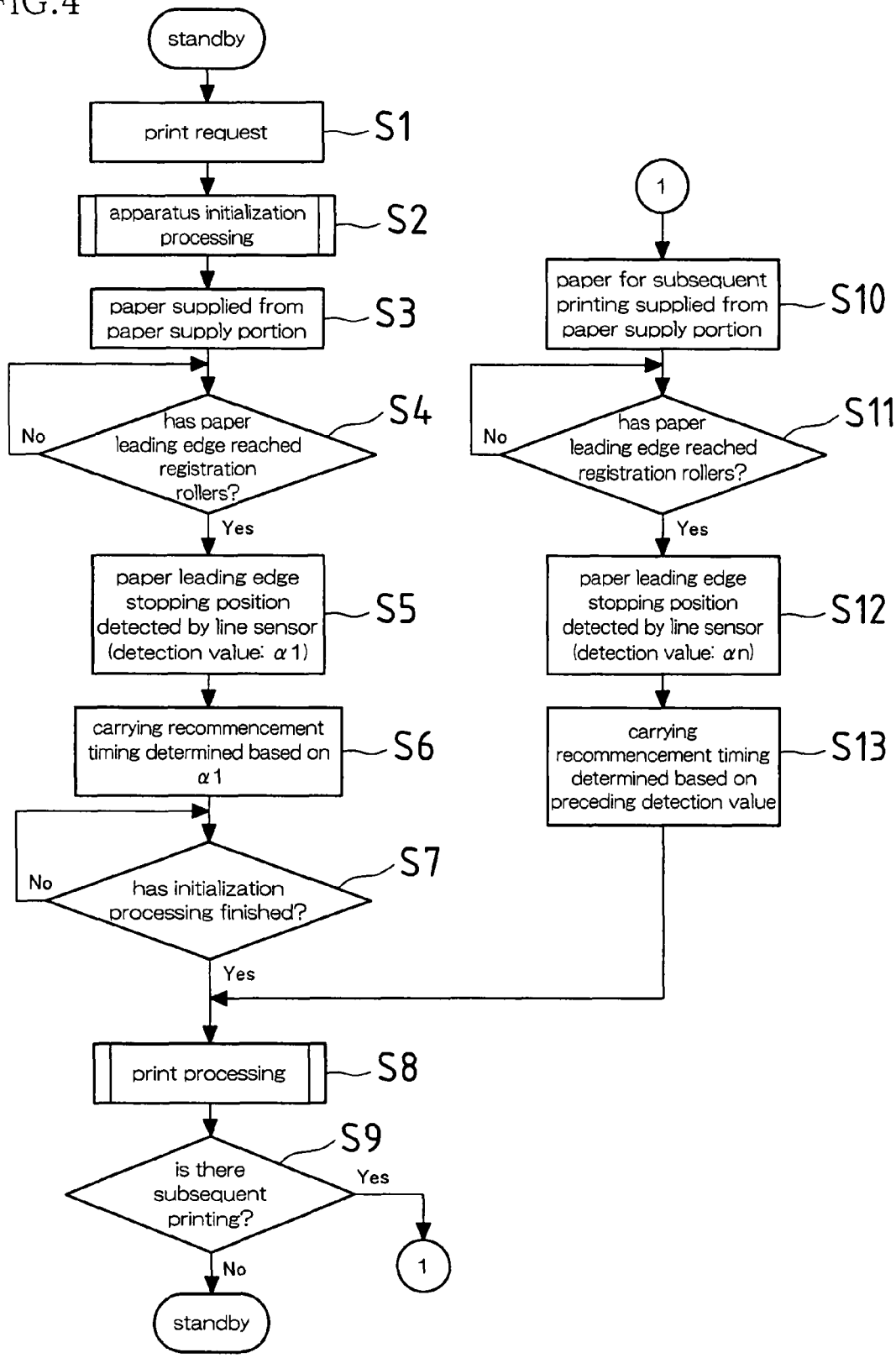
FIG. 4 is a flowchart for describing a process for determining the carrying recommencement timing of working example 1.

Working example 1 is a working example in which the carrying recommencement timing of the paper being temporarily stopped by the registration rollers R51 and R52 is determined based on leading edge detection values of the immediately preceding carried paper. Next, description is given of a process for determining the carrying recommencement timing in working example 1 with reference to the flowchart shown in FIG. 4.

When a print request is received (step S1) for successive printing of multiple sheets by operation of the operation panel 10, the control portion 101 commences (step S2) an initialization process of the apparatus. For example, initialization processing is commenced on the photosensitive drum 14 such as adjustment of the charging electric potential by the charging device 15 and removal of toner smearing on the surface of the photosensitive drum 14 by the cleaner 18.

At this time, the control portion 101 supplies (step S3) a first sheet from one of the paper supply cassettes 26, which is carried toward the photosensitive drum 14 by the carry rollers R31 and R32 via the shared carry path 28, then its trailing edge is sandwiched by the pre-registration rollers R41 and R42 and its front edge makes contacts and stops at the registration rollers R51 and R52. When the paper leading edge reaches the registration rollers R51 and R52 (when determined Yes at step S4), the paper leading edge stopping position of the first sheet is detected (step S5) by the paper leading edge detection means 70, and a detection value $\alpha 1$ is stored in the memory 104.

Based on the detection value $\alpha 1$, the control portion 101 determines (step S6) a carrying recommencement timing T1 for the first sheet of paper so that the leading edge of the image information visualized on the photosensitive drum 14 and the leading edge of the first sheet of paper being stopped by the registration rollers R51 and R52 correspond.

After this, when completion of initialization processing of the apparatus is confirmed (when determined Yes at step S7), the control portion 101 commences print processing (step S8). Namely, driving of the registration rollers R51 and R52 and the pre-registration rollers R41 and R42 recommences at the carrying recommencement timing T1 decided above, and carrying (print processing) of the first sheet of paper commences.

Simultaneous to this, the control portion 101 confirms (step S9) whether or not there is subsequent printing and when there is subsequent printing, a next sheet (the second sheet in this case) is supplied (step S10) from the paper supply cassettes 26, carried toward the photosensitive drum 14 by the carry rollers R31 and R32 via the shared carry path 28, then its trailing edge is sandwiched by the pre-registration rollers R41 and R42 and its front edge makes contacts and stops at the registration rollers R51 and R52. When the paper leading edge reaches the registration rollers R51 and R52 (when determined Yes at step S11), the paper leading edge stopping position of the second sheet is detected (step S12) by the paper leading edge detection means 70, and a detection value $\alpha n$ (n=2) is stored in the memory 104.

Meanwhile, based on the preceding detection value $\alpha 1$, the control portion 101 determines (step S13) a carrying recommencement timing Tn (n=2) for the second sheet of paper so that the leading edge of the image information visualized on the photosensitive drum 14 and the leading edge of the second sheet of paper being stopped by the registration rollers R51 and R52 correspond. Then, driving of the registration rollers R51 and R52 and the pre-registration rollers R41 and R42 recommences at the carrying recommencement timing Tn (n=2) decided at step S13, and carrying (print processing) of the second sheet of paper commences.

Simultaneous to this, the control portion 101 confirms (step S9) whether or not there is subsequent printing and when there is subsequent printing, the next sheet (the third sheet in this case) is supplied (step S10) from the paper supply cassettes 26, carried toward the photosensitive drum 14 by the carry rollers R31 and R32 via the shared carry path 28, then its trailing edge is sandwiched by the pre-registration rollers R41 and R42 and its front edge makes contacts and stops at the registration rollers R51 and R52. When the paper leading edge reaches the registration rollers R51 and R52 (when determined Yes at step S11), the paper leading edge stopping position of the third sheet is detected (step S12) by the paper leading edge detection means 70, and a detection value $\alpha n$ (n=3) is stored in the memory 104.

Meanwhile, based on the preceding detection value $\alpha n$ (n=2), the control portion 101 determines (step S13) a carrying recommencement timing Tn (n=3) for the third sheet of paper so that the leading edge of the image information visualized on the photosensitive drum 14 and the leading edge of the third sheet of paper being stopped by the registration rollers R51 and R52 correspond. Then, driving of the registration rollers R51 and R52 and the pre-registration rollers R41 and R42 recommences at the carrying recommencement timing Tn (n=3) decided at step S13, and carrying (print processing) of the third sheet of paper commences.

The control portion 101 executes print processing on the papers from the second sheet onward by repeating the processing of the above-described steps S9 to S13.

That is, in working example 1, the carrying recommencement timing for the next sheet is always determined using the detection value of the one preceding sheet. That is, since the detection value of the one preceding sheet is used without using the detection value of the leading edge stopping position of the actual sheet that has been carried to and stopped at the registration rollers R51 and R52, it is possible to determine the carrying recommencement timing for that sheet even before the sheet is carried to the registration rollers R51 and R52. Thus, with time to spare it is possible to determine easily and reliably the carrying recommencement timing of a sheet being temporarily stopped by the registration rollers R51 and R52, even during high speed carrying such as carrying approximately two A4 sheets sideways per second.

WORKING EXAMPLE 2

The positions of the paper leading edge when temporarily stopped by the registration rollers R51 and R52 are not always the same position for successive sheets and there is a possibility that displacement will occur to a greater or lesser extent. Working example 2 gives consideration to this point and is a working example in which the slight displacement between each sheet of paper is absorbed by obtaining an average value of the detection values of leading edge stopping positions of successively carried sheets, thereby determining the carrying recommencement timings with even higher accuracy.

Figure 5:
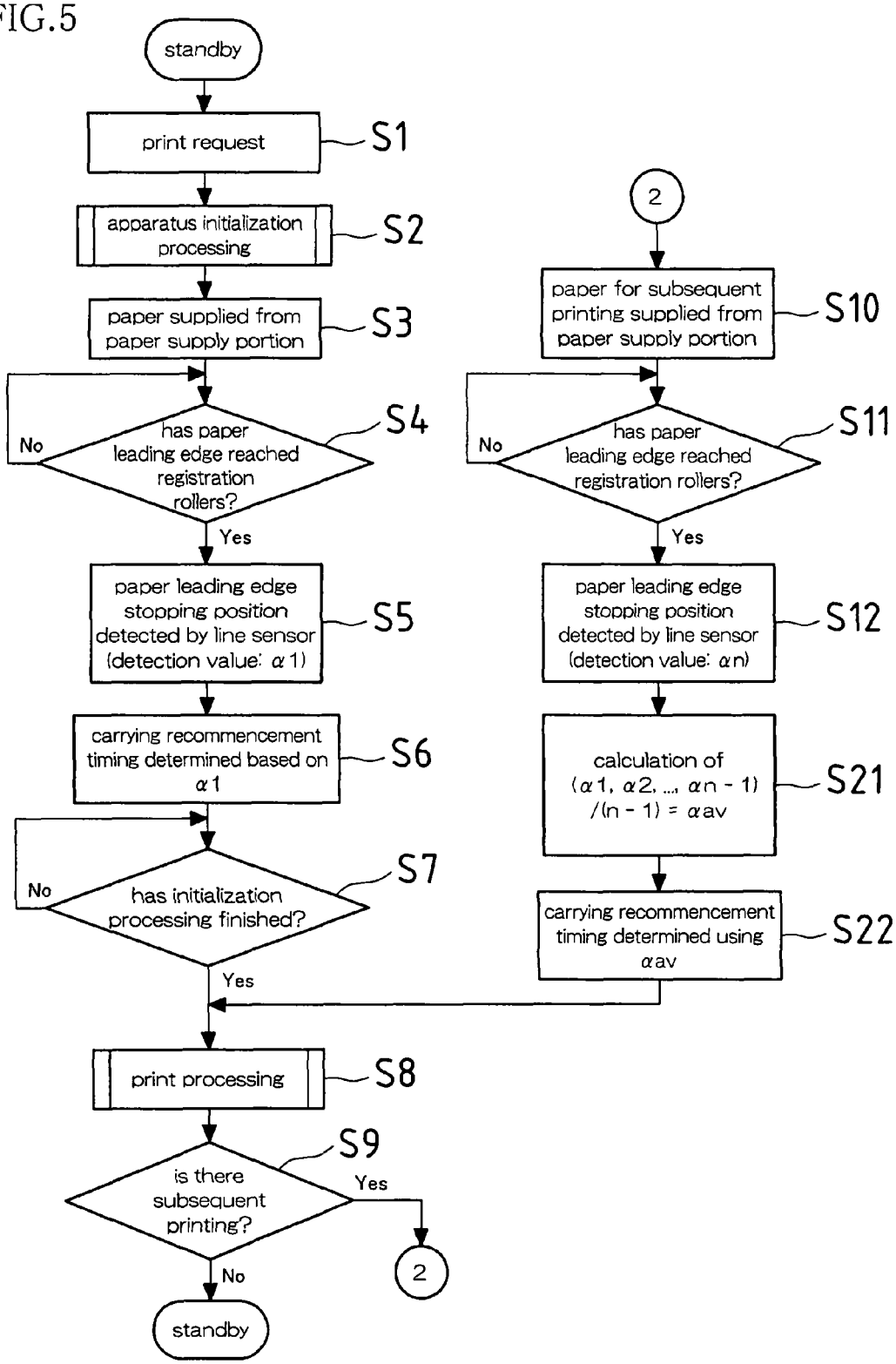
FIG. 5 is a flowchart for describing a process for determining the carrying recommencement timing of working example 2.

Next, description is given of a process for determining the carrying recommencement timing in working example 2 with reference to the flowchart shown in FIG. 5. It should be noted that in FIG. 5 the same step numbers are applied to processes that are the same in the flowchart shown in FIG. 4.

When a print request is received (step S1) for successive printing of multiple sheets by operation of the operation panel 10, the control portion 101 commences (step S2) an initialization process of the apparatus.

At this time, the control portion 101 supplies (step S3) a first sheet from one of the paper supply cassettes 26, which is carried toward the photosensitive drum 14 by the carry rollers R31 and R32 via the shared carry path 28, then its trailing edge is sandwiched by the pre-registration rollers R41 and R42 and its front edge makes contacts and stops at the registration rollers R51 and R52. When the paper leading edge reaches the registration rollers R51 and R52 (when determined Yes at step S4), the paper leading edge stopping position of the first sheet is detected (step S5) by the paper leading edge detection means 70, and a detection value $\alpha 1$ is stored in the memory 104.

Based on the detection value $\alpha 1$, the control portion 101 determines (step S6) a carrying recommencement timing T1 for the first sheet of paper so that the leading edge of the image information visualized on the photosensitive drum 14 and the leading edge of the first sheet of paper being stopped by the registration rollers R51 and R52 correspond.

After this, when completion of initialization processing of the apparatus is confirmed (when determined Yes at step S7), the control portion 101 commences print processing (step S8). Namely, driving of the registration rollers R51 and R52 and the pre-registration rollers R41 and R42 recommences at the carrying recommencement timing T1 decided above, and carrying (print processing) of the first sheet of paper commences.

Simultaneous to this, the control portion 101 confirms (step S9) whether or not there is subsequent printing and when there is subsequent printing, a next sheet (the second sheet in this case) is supplied (step S10) from the paper supply cassettes 26, carried toward the photosensitive drum 14 by the carry rollers R31 and R32 via the shared carry path 28, then its trailing edge is sandwiched by the pre-registration rollers R41 and R42 and its front edge makes contacts and stops at the registration rollers R51 and R52. When the paper leading edge reaches the registration rollers R51 and R52 (when determined Yes at step S11), the paper leading edge stopping position of the second sheet is detected (step S12) by the paper leading edge detection means 70, and a detection value $\alpha n$ (n=2) is stored in the memory 104.

Meanwhile, based on an average value $\alpha av$ (in this case, $\alpha 1$), which is a calculation result of calculating (step S21) $\alpha av=\alpha 1/1$ using the preceding detection value $\alpha 1$, the control portion 101 determines (step S22) a carrying recommencement timing Tn (n=2) for the second sheet of paper so that the leading edge of the image information visualized on the photosensitive drum 14 and the leading edge of the second sheet of paper being stopped by the registration rollers R51 and R52 correspond. Then, driving of the registration rollers R51 and R52 and the pre-registration rollers R41 and R42 recommences at the carrying recommencement timing Tn (n=2) decided at step S22, and carrying (print processing) of the second sheet of paper commences.

Simultaneous to this, the control portion 101 confirms (step S9) whether or not there is subsequent printing and when there is subsequent printing, the next sheet (the third sheet in this case) is supplied (step S10) from the paper supply cassettes 26, carried toward the photosensitive drum 14 by the carry rollers R31 and R32 via the shared carry path 28, then its trailing edge is sandwiched by the pre-registration rollers R41 and R42 and its front edge makes contacts and stops at the registration rollers R51 and R52. When the paper leading edge reaches the registration rollers R51 and R52 (when determined Yes at step S11), the paper leading edge stopping position of the third sheet is detected (step S12) by the paper leading edge detection means 70, and a detection value $\alpha n$ (n=3) is stored in the memory 104.

Meanwhile, based on the average value $\alpha av$, which is a calculation result of calculating (step S21) of $\alpha av=(\alpha 1+\alpha 2)/2$ using all of the preceding detection values $\alpha 1$ and $\alpha 2$ up until then, the control portion 101 determines (step S22) a carrying recommencement timing Tn (n=3) for the third sheet of paper so that the leading edge of the image information visualized on the photosensitive drum 14 and the leading edge of the third sheet of paper being stopped by the registration rollers R51 and R52 correspond. Then, driving of the registration rollers R51 and R52 and the pre-registration rollers R41 and R42 recommences at the carrying recommencement timing Tn (n=3) decided at step S22, and carrying (print processing) of the third sheet of paper commences.

Simultaneous to this, the control portion 101 confirms (step S9) whether or not there is subsequent printing and when there is subsequent printing, the next sheet (the fourth sheet in this case) is supplied (step S10) from the paper supply cassettes 26, carried toward the photosensitive drum 14 by the carry rollers R31 and R32 via the shared carry path 28, then its trailing edge is sandwiched by the pre-registration rollers R41 and R42 and its front edge makes contacts and stops at the registration rollers R51 and R52. When the paper leading edge reaches the registration rollers R51 and R52 (when determined Yes at step S11), the paper leading edge stopping position of the fourth sheet is detected (step S12) by the paper leading edge detection means 70, and a detection value $\alpha n$ (n=4) is stored in the memory 104.

Meanwhile, based on the average value $\alpha av$, which is a calculation result of calculating (step S21) of $\alpha av=(\alpha 1+\alpha 2+\alpha 3)/3$ using all of the preceding detection values $\alpha 1$, $\alpha 2$, and $\alpha 3$ up until then, the control portion 101 determines (step S22) a carrying recommencement timing Tn (n=4) for the fourth sheet of paper so that the leading edge of the image information visualized on the photosensitive drum 14 and the leading edge of the fourth sheet of paper being stopped by the registration rollers R51 and R52 correspond. Then, driving of the registration rollers R51 and R52 and the pre-registration rollers R41 and R42 recommences at the carrying recommencement timing Tn (n=4) decided at step S22, and carrying (print processing) of the fourth sheet of paper commences.

The control portion 101 repeats the processing of the above steps S9 to S22, and executes print processing on the second sheet onward by using all the preceding detection values $\alpha 1$, $\alpha 2, \ldots, \alpha n-1$ up until then to calculate each time at step S21 the average value $\alpha av=(\alpha 1+\alpha 2 \ldots +\alpha n-1)/(n-1)$ thereof.

That is, in working example 2, the carrying recommencement timing for the sheet being carried is determined using all the detection values of all the sheets being carried to the registration rollers R51 and R52 up until the immediately preceding sheet. That is, since all the detection values of all the sheets up until the one preceding sheet are used without using the detection value of the leading edge stopping position of the actual sheet that has been carried to and stopped at the registration rollers R51 and R52, it is possible to determine the carrying recommencement timing for that sheet even before the sheet is carried to the registration rollers R51 and R52. Thus, with time to spare it is possible to determine easily and reliably the carrying recommencement timing of a sheet being temporarily stopped by the registration rollers R51 and R52, even during high speed carrying such as carrying approximately two A4 sheets sideways per second.

WORKING EXAMPLE 3

There is a high probability that the paper leading edge stopping positions when temporarily stopped by the registration rollers R51 and R52 will gradually shift over time. However, although this shifting does not vary extremely between a preceding sheet and a subsequent sheet, it is possible for considerable shifting to occur between the first sheet and the thirty-first sheet for example. For example, in successive printing of multiple sheets (for example, large volume printing of around 500 sheets), it is conceivable that thermal expansion will occur due to the heat produced by rubbing between the registration rollers R51 and R52 and the paper, and since the paper leading edge stopping positions may gradually change due to this thermal expansion or the like, there is a possibility that accuracy will be worsened when using the earlier values in the average value calculations indefinitely. Working example 3 gives consideration to this point and is a working example in which the average value calculation process is initialized for every certain number of sheets.

Figure 6:
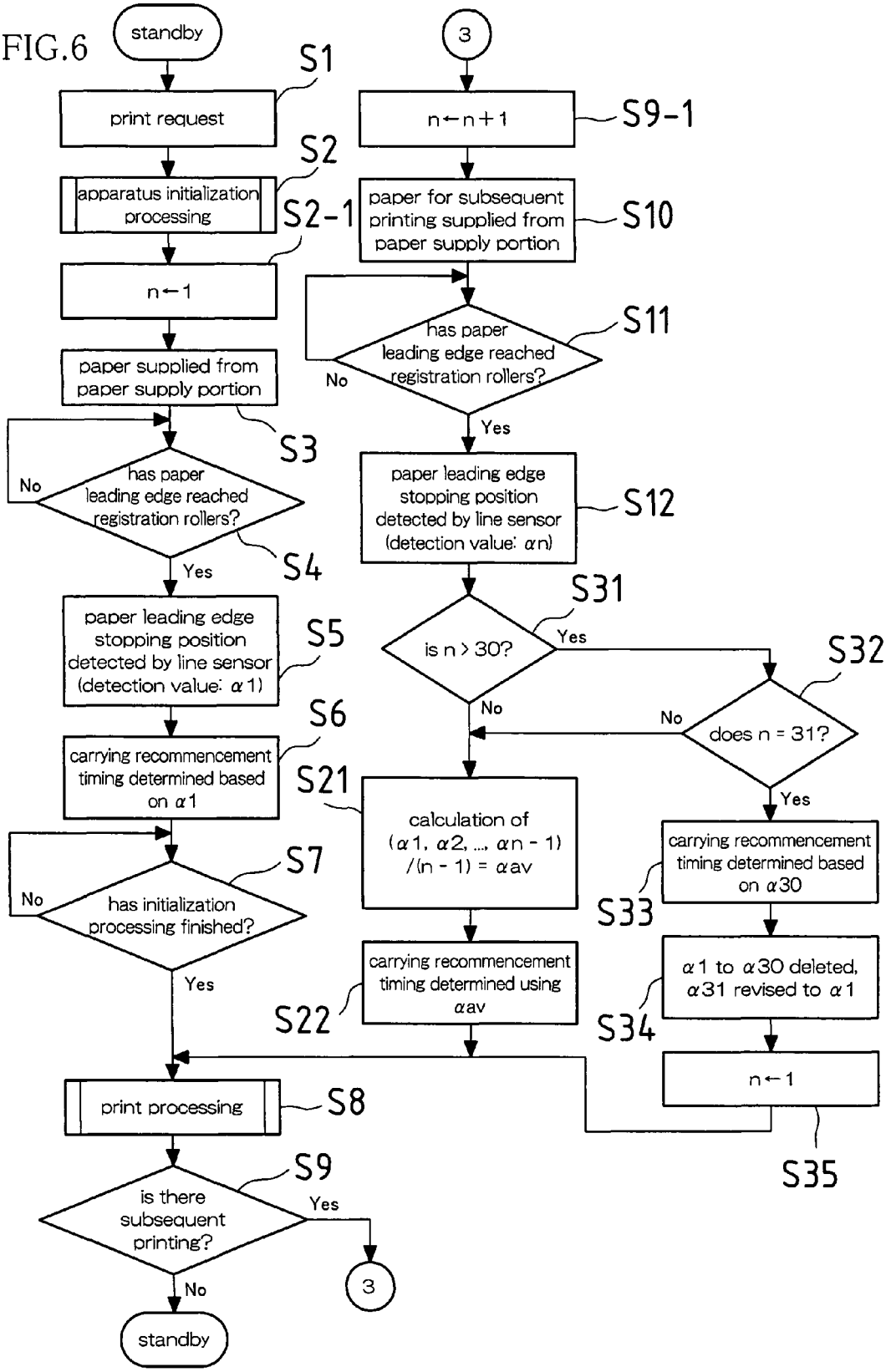
FIG. 6 is a flowchart for describing a process for determining the carrying recommencement timing of working example 3.

Next, description is given of a process for determining the carrying recommencement timing in working example 3 with reference to the flowchart shown in FIG. 6. It should be noted that in FIG. 6 the same step numbers are applied to processes that are the same in the flowchart shown in FIG. 5.

Here, in working example 3, the fixed number of sheets is set at 30 sheets. That is, the number of sheets for which there is a print request is divided for every 30 sheets, and the calculation process for the average value $\alpha av$ is initialized for each of these divisions, that is, for each set of 30 sheets. Next, description is given of a process for determining the carrying recommencement timing in working example 3 with reference to the flowchart shown in FIG. 6.

When a print request is received (step S1) for successive printing of multiple sheets by operation of the operation panel 10, the control portion 101 commences (step S2) an initialization process of the apparatus.

At this time, after setting (step S2-1) n, which indicates the number of sheets that have been carried, to 1, the control portion 101 supplies (step S3) a first sheet from one of the paper supply cassettes 26, which is carried toward the photosensitive drum 14 by the carry rollers R31 and R32 via the shared carry path 28, then its trailing edge is sandwiched by the pre-registration rollers R41 and R42 and its front edge makes contacts and stops at the registration rollers R51 and R52. When the paper leading edge reaches the registration rollers R51 and R52 (when determined Yes at step S4), the paper leading edge stopping position of the first sheet is detected (step S5) by the paper leading edge detection means 70, and a detection value $\alpha 1$ is stored in the memory 104.

Based on the detection value $\alpha 1$, the control portion 101 determines (step S6) a carrying recommencement timing T1 for the first sheet of paper so that the leading edge of the image information visualized on the photosensitive drum 14 and the leading edge of the first sheet of paper being stopped by the registration rollers R51 and R52 correspond.

After this, when completion of initialization processing of the apparatus is confirmed (when determined Yes at step S7), the control portion 101 commences print processing (step S8). Namely, driving of the registration rollers R51 and R52 and the pre-registration rollers R41 and R42 recommences at the carrying recommencement timing T1 decided above, and carrying (print processing) of the first sheet of paper commences.

Simultaneous to this, the control portion 101 confirms (step S9) whether or not there is subsequent printing and when there is subsequent printing, after incrementing (step S9-1) n, which indicates the number of sheets that have been carried, a next sheet (the second sheet in this case) is supplied (step S10) from the paper supply cassettes 26, which is carried toward the photosensitive drum 14 by the carry rollers R31 and R32 via the shared carry path 28, then its trailing edge is sandwiched by the pre-registration rollers R41 and R42 and its front edge makes contacts and stops at the registration rollers R51 and R52. When the paper leading edge reaches the registration rollers R51 and R52 (when determined Yes at step S11), the paper leading edge stopping position of the second sheet is detected (step S12) by the paper leading edge detection means 70, and a detection value $\alpha n$ (n=2) is stored in the memory 104.

Next, the control portion 101 confirms (step S31) whether or not the number of sheets that have been carried successively has exceeded 30 sheets, which is a single division, and if this is not exceeded (when determined No at step S31), then based on the average value $\alpha av$ (in this case, $\alpha 1$), which is a calculation result of calculating (step S21) $\alpha av=\alpha 1/1$ using the preceding detection value $\alpha 1$, the control portion 101 determines (step S22) a carrying recommencement timing Tn (n=2) for the second sheet of paper so that the leading edge of the image information visualized on the photosensitive drum 14 and the leading edge of the second sheet of paper being stopped by the registration rollers R51 and R52 correspond. Then, driving of the registration rollers R51 and R52 and the pre-registration rollers R41 and R42 recommences at the carrying recommencement timing Tn (n=2) decided at step S22, and carrying (print processing) of the second sheet of paper commences.

Simultaneous to this, the control portion 101 confirms (step S9) whether or not there is subsequent printing and when there is subsequent printing, after incrementing (step S9-1) n, which indicates the number of sheets that have been carried, the next sheet (the third sheet in this case) is supplied (step S10) from the paper supply cassettes 26, carried toward the photosensitive drum 14 by the carry rollers R31 and R32 via the shared carry path 28, then its trailing edge is sandwiched by the pre-registration rollers R41 and R42 and its front edge makes contacts and stops at the registration rollers R51 and R52. When the paper leading edge reaches the registration rollers R51 and R52 (when determined Yes at step S11), the paper leading edge stopping position of the third sheet is detected (step S12) by the paper leading edge detection means 70, and a detection value $\alpha n$ (n=3) is stored in the memory 104.

Next, the control portion 101 confirms (step S31) whether or not the number of sheets that have been carried successively has exceeded 30 sheets, which is a single division, and if this is not exceeded (when determined No at step S31), then based on the average value $\alpha av$, which is a calculation result of calculating (step S21) $\alpha av=(\alpha 1+\alpha 2)/2$ using all the preceding detection values $\alpha 1$ and $\alpha 2$ up until then, the control portion 101 determines (step S22) a carrying recommencement timing Tn (n=3) for the third sheet of paper so that the leading edge of the image information visualized on the photosensitive drum 14 and the leading edge of the third sheet of paper being stopped by the registration rollers R51 and R52 correspond. Then, driving of the registration rollers R51 and R52 and the pre-registration rollers R41 and R42 recommences at the carrying recommencement timing Tn (n=3) decided at step S22, and carrying (print processing) of the third sheet of paper commences.

In this manner the control portion 101 repeats the processing of the above steps S9 to S22, and executes print processing on the second sheet onward by using all the preceding detection values $\alpha 1, \alpha 2, \ldots, \alpha n-1$ up until then to calculate each time at step S21 the average value $\alpha av=(\alpha 1+\alpha 2+\ldots+\alpha n-1)/(n-1)$ thereof. In repeating the processes of the steps S9 to S22 in this manner, when the control portion 101 has confirmed that the number of successively carried sheets has exceeded 30 sheets, which is a single division, (when determined Yes at step S31), next a confirmation is made (step S32) as to whether or not the paper carried in this time is the thirty-first successively carried sheet (that is, the first sheet of the next division).

When a result is that the number of successively carried sheets is up to the thirty-first sheet, a carrying recommencement timing Tn is determined (step S33) based on $\alpha 30$, which is the detection value of the immediately preceding thirtieth sheet, so that the leading edge of the image information visualized on the photosensitive drum 14 and the leading edge of the paper being stopped by the registration rollers R51 and R52 correspond. That is, in the process of step S33, it is deemed that the thirtieth sheet is essentially a first sheet of a new division, and in this sense is the same process as step S6.

After this, $\alpha 1$ to $\alpha 30$, which constitute the past history stored in the memory 104, are deleted and after the detection value $\alpha 31$ stored in the memory 104 at this time undergoes a symbol update to $\alpha 1$ (that is, after the detection value is left as it is and only the symbol is updated), n, which indicates the number of carried sheets is initialized (step S35) to 1 and the procedure returns to step S9. In this way, the carrying recommencement timings for the next division of 30 sheets are successively determined in a same manner as the preceding division of 30 sheets.

That is, in working example 3, the calculation processing of the above-described working example 2 is implemented while being initialized for each division of a preset number of sheets (30 sheets in the example here). That is, since all the detection values of all the sheets up until the one preceding sheet within the same division are used without using the detection value of the leading edge stopping position of the actual sheet that has been carried to and stopped at the registration rollers R51 and R52, it is possible to determine the carrying recommencement timing for that sheet even before the sheet is carried to the registration rollers R51 and R52. Thus, with time to spare it is possible to determine easily and reliably the carrying recommencement timing of a sheet being temporarily stopped by the registration rollers R51 and R52, even during high speed carrying such as carrying approximately two A4 sheets sideways per second.

WORKING EXAMPLE 4

The above-described working examples 1 to 3 involved a single print request, that is, processing within a single job, but working example 4 involves successive print requests, that is, successively executing multiple jobs. That is, ordinarily, when print requests are different, it is probable that the paper size and the paper supply cassette to be used will vary. Thus, consideration was given to this in working examples 1 to 3 and processing was concluded for each print request individually.

Figure 7:
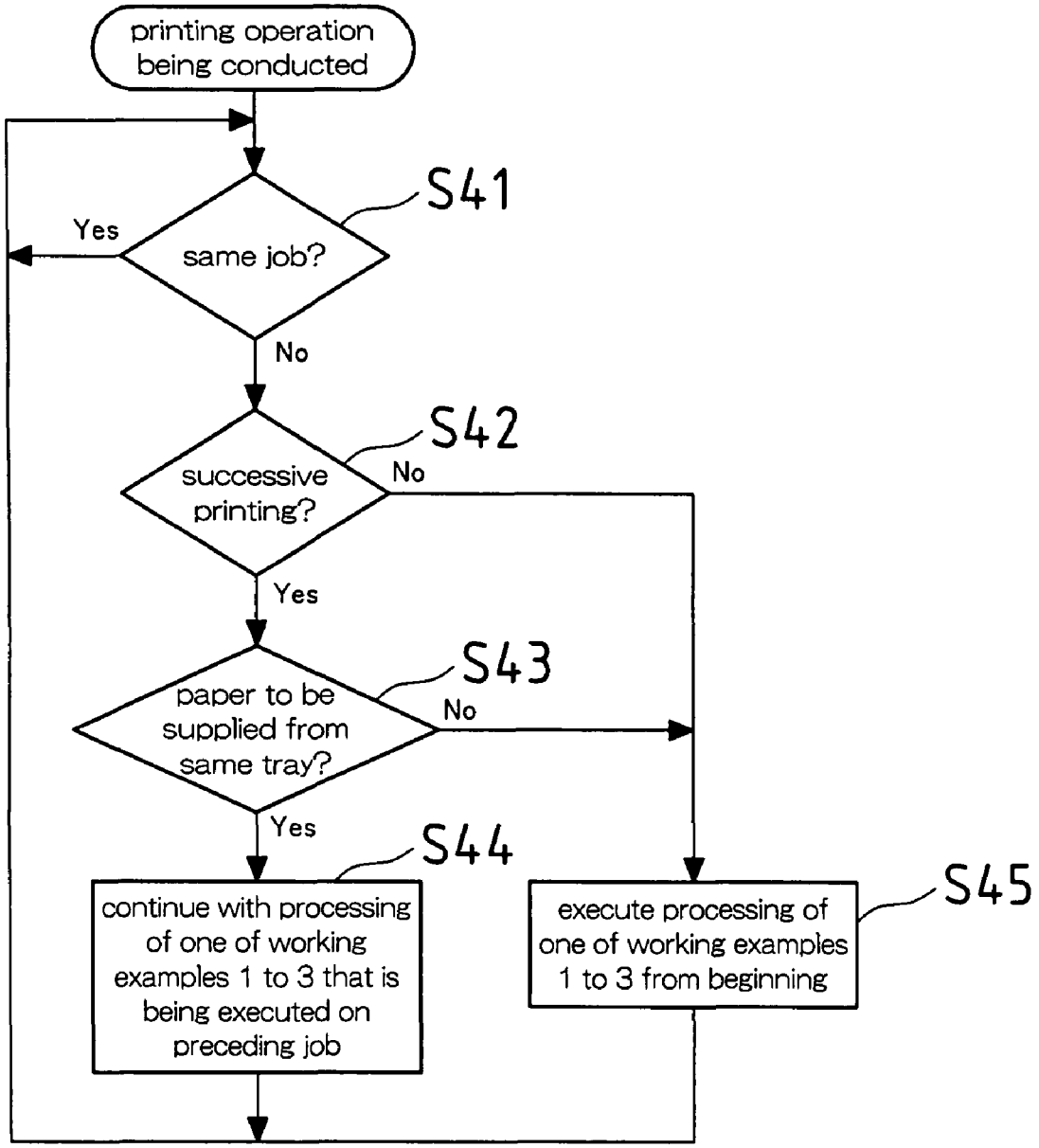
FIG. 7 is a flowchart for describing a process for determining the carrying recommencement timing of working example 4.

However, in a case where even though there are multiple print requests, the multiple print requests are to be processed continuously without stopping operation of the apparatus and where the same paper supply cassette is to be used, the processing of the above-described working examples 1 to 3 can be executed continuously for the continuous print requests without causing any problem. Working example 4 is a working example that gives consideration to this point. Next, description is given of a process for determining the carrying recommencement timing in working example 4 with reference to the flowchart shown in FIG. 7.

When multiple print requests are being made, the control portion 101 always monitors (step S41) whether or not the current print processing is the same single print request, that is, whether or not it is print processing of the same job. Then, when print processing for the single job is finished and print processing for the next job is to be executed, confirmation is made (step S42) as to whether or not the processing for the next job involves successive printing, which is executed continuously from the completion of processing of the previous job without stopping the apparatus, and when this is successive printing (when determined Yes at step S42), next a confirmation is made (step S43) as to whether or not the paper tray to supply paper is the same tray as the paper tray that was used for the one preceding job.

When a result thereof is that it is the same paper tray (when determined Yes at step S43), the control portion 101 continues to execute (step S44) the processing of one of the working examples 1 to 3 (the processing in one of FIGS. 4 to 6) that had been executed for the one preceding job also on the next job.

On the other hand, when this is not successive printing (No at step S42) and not the same paper tray (No at step S43), processing of one of the above-described working examples 1 to 3 is executed from the beginning on the next print request.

WORKING EXAMPLE 5

When successive printing is being carried out at high speed, it is possible that the registration rollers R51 and R52 will expand due to the heat produced by abrasion between the nip portion N5 of the registration rollers R51 and R52 and the sheets that pass therebetween. And due to the registration rollers R51 and R52 being subjected to expansion or the like, it is probable that the leading edge stopping positions of the sheets sandwiched there will vary greatly from a certain point in time. Thus, working example 5 gives consideration to this point by obtaining the extent of a difference value between detection values of leading edge stopping positions of every two sheets that are carried successively and initializes the calculation processing of the average value in the process for determining the carrying recommencement timing of either the above-described working example 2 or working example 3 when that difference value has exceeded a preset allowable value. Here, the allowable value is obtained in advance through testing or the like and set giving consideration to such properties as the thermal expansion characteristics of the rollers due to the heat produced by rotational friction of the registration rollers R51 and R52 and internal temperature rises within the apparatus.

Figure 8:
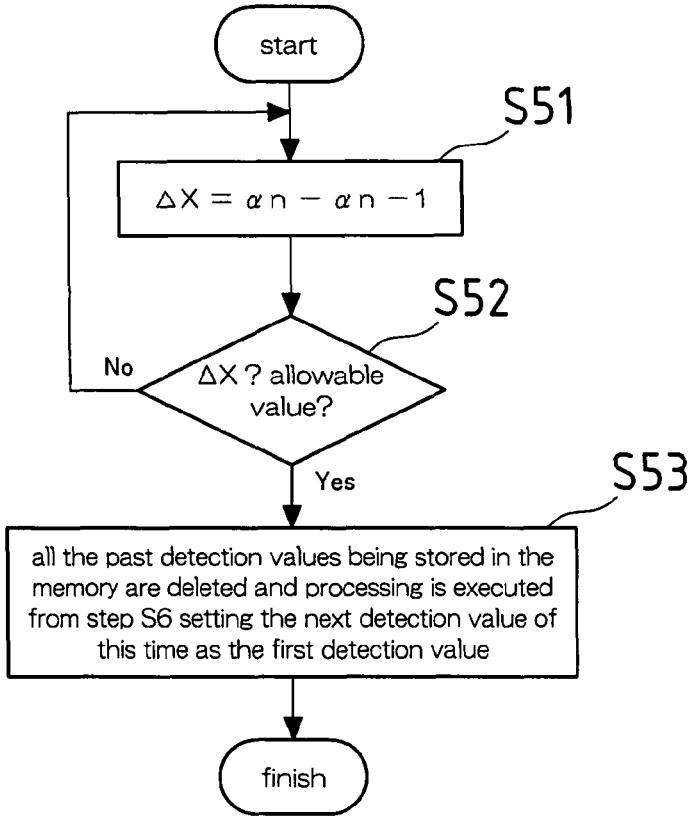
FIG. 8 is a flowchart for describing a process for determining the carrying recommencement timing of working example 5.

Next, description is given of a process for determining the carrying recommencement timing in working example 5 with reference to the flowchart shown in FIG. 8. That is, in working example 5, the following processing is executed in parallel to the process for determining the carrying recommencement timing of either the above-described working example 2 or working example 3.

Namely, when the paper leading edge stopping position of the paper being sandwiched in the registration rollers R51 and R52 is detected by the paper leading edge detection means 70 in step S12, which is the process for determining the carrying recommencement timing of either the above-described working example 2 or working example 3, the control portion 101 obtains (step S51) a difference value $\Delta X$ of the detection value $\alpha n$ and one preceding detection value $\alpha n-1$, then compares (step S52) that difference value $\Delta X$ and an allowable value X1 that has been set in advance. Then, when $\Delta X$ is below the allowable value X1, that is, when it is within the range of the allowable value X1 (when determined No at step S52), processing of step S12 onward is executed with change.

On the other hand, when $\Delta X$ is not less than the allowable value X1 (when determined Yes at step S52), processing from step S6 is executed. That is, all the past detection values $\alpha 1$, $\alpha 2$, . . . , $\alpha n-1$ being stored in the memory 104 up until then are all deleted and initialized, and the process for determining the carrying recommencement timing continues from step S6 setting the next detection value $\alpha n$ of this time as the first detection value.

Thus, even if the paper leading edge stopping position suddenly varies greatly due to a cause such as the heat produced in the registration rollers, it becomes possible to handle this immediately and to determine the carrying recommencement timings with excellent accuracy.

WORKING EXAMPLE 6

In the above-described working examples 2 and 3, the carrying recommencement timing of the sheet to be carried next was determined using a past detection value $\alpha n$, but a condition of this determination technique is that the sheets to be carried are sheets of the same size. That is, when the paper supply cassette is switched during print processing, it is possible that the size of the paper being supplied will change at that point in time, and therefore the past detection values $\alpha n$ will no longer hold any meaning at all in such cases. Thus, working example 6 gives consideration to this point by initializing the calculation processing of the average value in the process for determining the carrying recommencement timing of either the above-described working example 2 or working example 3 when the paper supply cassette has been switched during print processing of a single job.

Figure 9:
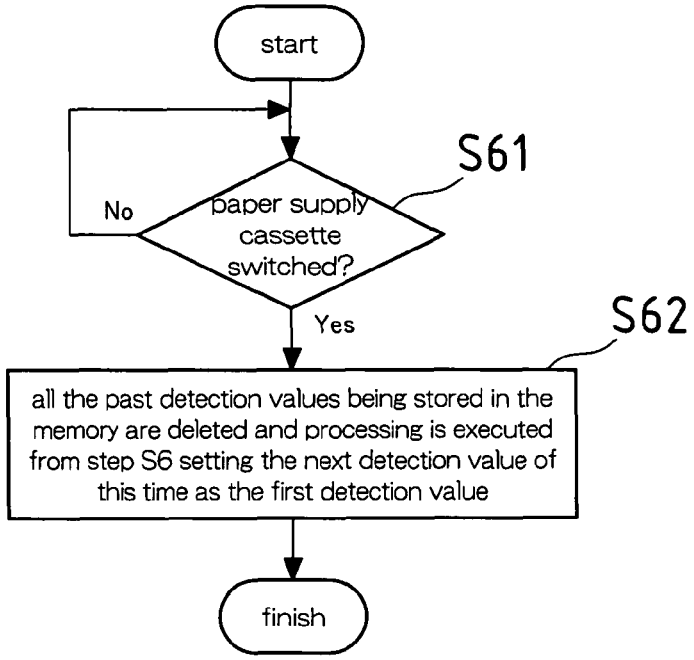
FIG. 9 is a flowchart for describing a process for determining the carrying recommencement timing of working example 6.

Next, description is given of a process for determining the carrying recommencement timing in working example 6 with reference to the flowchart shown in FIG. 9. That is, in working example 6, the following processing is executed in parallel to the process for determining the carrying recommencement timing of either the above-described working example 2 or working example 3.

That is, the control portion 101 monitors (step S61) whether or not the paper supply cassette has been switched during the process for determining the carrying recommencement timing of either the above-described working example 2 or working example 3. Switching of the paper supply cassettes may involve a case for example of switching to any of the four paper supply cassettes 26 that are detachably loaded from a front surface side of the image forming apparatus, or may involve a case of switching from these paper supply cassettes to the large capacity paper supply unit (LCC) 60 side, and further still may involve a case of switching from a paper supply cassette to any other paper supply cassette in the large capacity paper supply unit (LCC) 60, which are not shown in the drawings. When the control portion 101 detects switching of the paper supply cassette (when determined Yes at step S61), all the past detection values $\alpha 1, \alpha 2, \ldots, \alpha n-1$ being stored in the memory 104 up until then are all deleted and initialized, and the process for determining the carrying recommencement timing continues from step S6 setting the next detection value $\alpha n$ of this time as the first detection value.

Thus, even if the paper supply cassette is switched during print processing, it becomes possible to handle this immediately and to determine the carrying recommencement timings with excellent accuracy.

WORKING EXAMPLE 7

In the above-described working examples 2 and 3, the carrying recommencement timing of the sheet to be carried next was determined using a past detection value $\alpha n$, but a condition of this determination technique is that printing operations are continuous. That is, when print processing operations are interrupted during a single job, processing is executed from the initialization process when printing recommences, and therefore in such cases, all the past detection values $\alpha 1, \alpha 2, \ldots, \alpha n-1$ being stored in the memory 104 up until then are all deleted and initialized in a same manner as for cassette switching in the above-described working example 6, and processing is executed from the initialization processing of step S2.

WORKING EXAMPLE 8

Although there is no particular limitation to this, the above-described working examples 1 to 3 were working examples involving a case in which the print mode was single sided printing. However, in addition to single sided printing mode there is also a double sided printing mode. Working example 8 is a working example involving a case of double sided printing mode. Even for the same paper, the contact condition may vary when sandwiched by the registration rollers R51 and R52 for paper in the initial state on which there is no printing on either side and paper that has been printed on one side, and therefore it is possible that the paper leading edge stopping positions may vary when the papers contact and are stopped by the registration rollers R51 and R52. Thus, working example 8 gives consideration to this point, and when the print mode is double sided printing, any one of the above-described working examples 1 to 3 is executed for each printing surface (front side and rear side) of the sheet to determine the carrying recommencement timing for each printing surface.

That is, during print processing of a single job, the control portion 101 determines whether the paper that is carried to the registration rollers R51 and R52 is paper freshly supplied from the paper supply cassettes with no printing on either surface (front surface side printing) or paper that has already had its front surface side printed and has been supplied in a state having its front and rear inverted by the re-supplying roller 35 of the automatic double-side paper supply device 23 and carried in a state in which its front and reverse sides are inverted by the re-carrying roller 36 via the shared carry path 28 (rear surface side printing). Then, based on a determination result thereof, executes any one of the above-described working examples 1 to 3 respectively distinguishing between front surface side printing and rear surface side printing. That is, in the case of front surface side printing, detection is performed by the paper leading edge detection means 70 at the time of printing the front surface side and the carrying recommencement timing is determined using only detection values stored in the memory 104 of a time of front surface side printing, and in the case of rear surface side printing, detection is performed by the paper leading edge detection means 70 at the time of printing the rear surface side and the carrying recommencement timing is determined using only detection values stored in the memory 104 of a time of rear surface side printing. Thus, even for double sided printing, it becomes possible to respond to the condition for printing to the paper (cases of front surface side printing and cases of reverse surface side printing) and to determine the carrying recommencement timings with excellent accuracy.

An embodiment of the image forming apparatus of the present invention has modes for copying, printing, scanning, and faxing, and is suitably used in high-speed digital multi-function machines in which large volumes of printed materials undergo print processing at high speeds.

The present invention can be embodied and practiced in other different forms without departing from the spirit and essential characteristics thereof. Therefore, the above-described working examples are considered in all respects as illustrative and not restrictive. The scope of the invention is indicated by the appended claims rather than by the foregoing description. All variations and modifications falling within the equivalency range of the appended claims are intended to be embraced therein.

What is claimed is:

1. An image forming apparatus, comprising:

registration rollers arranged immediately before an electrostatic latent bearing member, the registration rollers temporarily stopping a carried paper;

a detector detecting a leading edge of the carried paper temporarily stopped by the registration rollers; and a controller configured to set a timer for a variable recommencement timing delay during which the registration rollers stop the carried paper, the registration rollers recommencing carrying of the paper after the timer counts down the variable recommencement timing delay, wherein the controller is further configured to calculate the variable recommencement timing delay to align a leading edge of image information visualized on the electrostatic latent bearing member and the leading edge of the carried paper detected by the detector, and at a time of successive printing of multiple sheets, the controller is further configured to calculate the variable recommencement timing delay for an immediately subsequent paper using information of the variable recommencement timing delay of an immediately preceding carried paper, wherein the controller is configured to calculate the variable recommencement timing delay of the immediately subsequent paper based on an average value of all variable recommencement timing delays of all preceding papers, the controller is further configured to divide a number of sheets for successive printing for which there is a print request into a preset multiple number of sheets, and the controller is further configured to calculate the average value by performing initialization for each division.

2. The image forming apparatus according to claim 1, wherein the controller is configured to determine the variable recommencement timing delay for an initial first sheet of paper in each division based on a detection value of a leading edge stopping position of a final sheet of an immediately preceding division.

3. The image forming apparatus according to claim 2, further comprising:

a plurality of paper storage portions, wherein the controller is configured to initialize a calculation process of the average value when a paper storage portion, which is to supply paper during successive printing processing of a single print request, has been switched.

4. The image forming apparatus according to claim 3, wherein in a case where a next print request is to be executed following completion of a single print request, the controller is configured to not initialize a calculation process of the average value and to continue calculating variable recommencement timing delays without initializing the average value when a same paper storage portion is to supply paper.

5. The image forming apparatus according to claim 2, wherein the controller is configured to initialize a calculation process of the average value when a print processing operation is interrupted during successive printing processing of a single print request process.

6. The image forming apparatus according to claim 2, wherein the controller is configured to calculate a difference value between detection values of leading edge stopping positions of every two sheets that are carried successively, compare the calculated difference value to a preset allowable value, and initialize the average value when the calculated difference value has exceeded the preset allowable value.

7. The image forming apparatus according to claim 1, further comprising:

a plurality of paper storage portions, wherein the controller is configured to initialize a calculation process of the average value when a paper storage portion, which is to supply paper during successive printing processing of a single print request, has been switched.

8. The image forming apparatus according to claim 7, wherein in a case where a next print request is to be executed following completion of a single print request, the controller is configured to not initialize a calculation process of the average value and to continue calculating variable recommencement timing delays without initializing the average value when a same paper storage portion is to supply paper.

9. The image forming apparatus according to claim 1, wherein the controller is configured to initialize a calculation process of the average value when a print processing operation is interrupted during successive printing processing of a single print request process.

10. The image forming apparatus according to claim 1, wherein the controller is configured to calculate a difference value between detection values of leading edge stopping positions of every two sheets that are carried successively, compare the calculated difference value to a preset allowable value, and initialize the average value when the calculated difference value has exceeded the preset allowable value.

* * * * *